US010006466B2

(12) United States Patent
Wilber et al.

(10) Patent No.: US 10,006,466 B2
(45) Date of Patent: Jun. 26, 2018

(54) CLAMPED HPC SEAL RING

(71) Applicant: United Technologies Corporation, Hartford, CT (US)

(72) Inventors: John E. Wilber, East Hampton, CT (US); Bernard J. Reilly, Coventry, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 308 days.

(21) Appl. No.: 14/685,225

(22) Filed: Apr. 13, 2015

(65) Prior Publication Data

US 2016/0298640 A1 Oct. 13, 2016

(51) Int. Cl.

| | |
|---|---|
| ***F01D 11/00*** | (2006.01) |
| ***F04D 29/08*** | (2006.01) |
| ***F01D 5/06*** | (2006.01) |
| ***F01D 5/34*** | (2006.01) |

(52) U.S. Cl.

CPC ..... *F04D 29/083* (2013.01); *F01D 5/06* (2013.01); *F01D 5/34* (2013.01); *F01D 11/001* (2013.01); *F05D 2240/55* (2013.01)

(58) Field of Classification Search

CPC .... F16J 15/447; F16J 15/4472; F16J 15/4474; F05D 2240/55; F01D 11/001; F01D 11/02

See application file for complete search history.

(56) References Cited

U.S. PATENT DOCUMENTS

| | | | | |
|---|---|---|---|---|
| 3,882,919 A | | 5/1975 | Sons, Jr. et al. | |
| 4,106,543 A | | 8/1978 | Sano | |
| 4,123,112 A | | 10/1978 | Mills | |
| 4,389,051 A | | 6/1983 | Mullaney | |
| 4,481,997 A | | 11/1984 | Strader | |
| 4,513,975 A | * | 4/1985 | Hauser | F01D 11/02 277/415 |
| 4,640,330 A | | 2/1987 | Frassica | |
| 4,721,313 A | * | 1/1988 | Pennink | F01D 11/02 277/412 |
| 4,836,261 A | | 6/1989 | Weeks et al. | |
| 5,018,566 A | | 5/1991 | Thoni | |
| 5,271,712 A | * | 12/1993 | Brandon | F01D 11/08 277/423 |

(Continued)

FOREIGN PATENT DOCUMENTS

WO WO 2008/052284 5/2008

OTHER PUBLICATIONS

Extended European Search Report dated Aug. 19, 2016 in European Application No. 16164960.3.

*Primary Examiner* — Gilbert Y Lee

(74) *Attorney, Agent, or Firm* — Snell & Wilmer, L.L.P.

(57) ABSTRACT

A seal ring for use between an integrally bladed rotor and a hub rotor of a compressor section of a gas turbine engine includes an arm configured to be positioned between the integrally bladed rotor and the hub rotor, such that the seal ring is removably coupled to the integrally bladed rotor and the hub rotor in response to a compressive force applied to the arm by the integrally bladed rotor and the hub rotor. The seal ring also includes a first blade coupled to the arm and configured to form a seal between a first volume and a second volume.

13 Claims, 3 Drawing Sheets

(56) References Cited

U.S. PATENT DOCUMENTS

| | | | | |
|---|---|---|---|---|
| 5,281,090 | A * | 1/1994 | Starling | F01D 11/02 277/413 |
| 5,343,920 | A | 9/1994 | Cady | |
| 6,267,553 | B1 | 7/2001 | Burge | |
| 7,083,238 | B2 | 8/2006 | Clements et al. | |
| 8,505,598 | B2 | 8/2013 | Marsaly et al. | |
| 2007/0297897 | A1 | 12/2007 | Tran et al. | |
| 2010/0124495 | A1 | 5/2010 | Bifulco | |

* cited by examiner

CLAMPED HPC SEAL RING

FIELD

The present disclosure relates generally to a seal of a gas turbine engine and, more particularly, to a rotating seal used in a high pressure compressor section of a gas turbine engine.

BACKGROUND

Gas turbine engines typically include compressors having multiple rows, or stages, of rotating blades and multiple stages of stators. In some parts of the gas turbine engine, it is desirable to create a seal between two volumes. For example, a first volume can define a portion of the gas path and thus receive relatively hot fluid. Fluid within a second volume can be used to cool components of the gas turbine engine and, thus, have a lower temperature than the fluid within the second volume. A rotating seal can be used to seal the first volume from the second volume as some parts defining the first and/or second volume rotate with respect to other parts defining the first and/or second volume.

SUMMARY

What is described is a seal ring for use between an integrally bladed rotor and a hub rotor of a compressor section of a gas turbine engine. The seal ring includes an arm configured to be positioned between the integrally bladed rotor and the hub rotor, such that the seal ring is removably coupled to the integrally bladed rotor and the hub rotor in response to a compressive force applied to the arm by the integrally bladed rotor and the hub rotor. The seal ring also includes a first blade coupled to the arm and configured to form a seal between a first volume and a second volume.

Also described is a system including an integrally bladed rotor of a compressor section of a gas turbine engine, the integrally bladed rotor being configured to rotate about an axis. The system also includes a hub rotor positioned aft of the integrally bladed rotor and configured to rotate about the axis. The system also includes a seal ring configured to be positioned between the integrally bladed rotor and the hub rotor and removably coupled to the integrally bladed rotor and the hub rotor via a compressive force. The seal ring is also configured to rotate about the axis in response to the integrally bladed rotor and the hub rotor rotating about the axis.

Also described is a seal ring for use between an integrally bladed rotor and a hub rotor of a compressor section of a gas turbine engine. The seal ring includes a radial arm configured to be axially positioned between the integrally bladed rotor and the hub rotor. The seal ring also includes an axial arm configured to be radially positioned between the integrally bladed rotor and the hub rotor, such that the seal ring is removably coupled to the integrally bladed rotor and the hub rotor in response to a compressive force applied to the seal ring by the integrally bladed rotor and the hub rotor.

The foregoing features and elements are to be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, is best be obtained by referring to the detailed description and claims when considered in connection with the drawing figures, wherein like numerals denote like elements.

DETAILED DESCRIPTION

Figure 1:
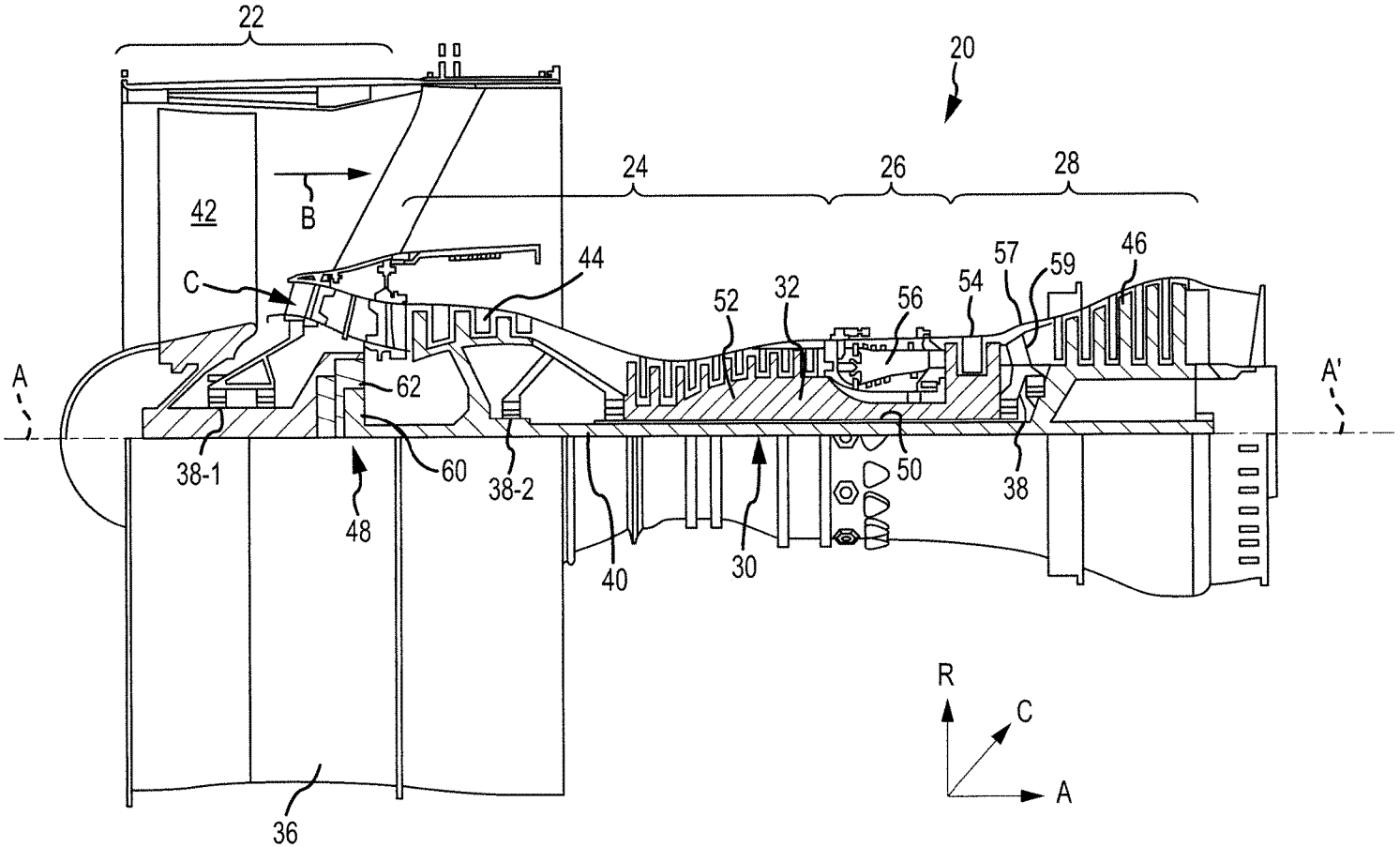
FIG. 1 illustrates a cross-sectional view of an exemplary gas turbine engine, in accordance with various embodiments.

With reference to FIG. 1, a gas turbine engine 20 is provided. An A-R-C axis illustrated in each of the figures illustrates the axial (A), radial (R) and circumferential (C) directions. As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion. As utilized herein, radially inward refers to the negative R direction and radially outward refers to the R direction.

Gas turbine engine 20 can be a two-spool turbofan that generally incorporates a fan section 22, a compressor section 24, a combustor section 26 and a turbine section 28. Alternative engines include an augmentor section among other systems or features. In operation, fan section 22 drives coolant along a bypass flow-path B while compressor section 24 drives coolant along a core flow-path C for compression and communication into combustor section 26 then expansion through turbine section 28. Although depicted as a turbofan gas turbine engine 20 herein, it should be understood that the concepts described herein are not limited to use with turbofans as the teachings can be applied to other types of turbine engines including three-spool architectures.

Gas turbine engine 20 generally comprises a low speed spool 30 and a high speed spool 32 mounted for rotation about an engine central longitudinal axis A-A' relative to an engine static structure 36 via several bearing systems 38, 38-1, and 38-2. It should be understood that various bearing systems 38 at various locations can alternatively or additionally be provided, including for example, bearing system 38, bearing system 38-1, and bearing system 38-2.

Low speed spool 30 generally includes an inner shaft 40 that interconnects a fan 42, a low pressure (or first) compressor section 44 and a low pressure (or first) turbine section 46. Inner shaft 40 is connected to fan 42 through a geared architecture 48 that can drive fan 42 at a lower speed than low speed spool 30. Geared architecture 48 includes a gear assembly 60 enclosed within a gear housing 62. Gear assembly 60 couples inner shaft 40 to a rotating fan structure. High speed spool 32 includes an outer shaft 50 that interconnects a high pressure (or second) compressor section 52 and high pressure (or second) turbine section 54. A combustor 56 is located between high pressure compressor 52 and high pressure turbine 54. A mid-turbine frame 57 of engine static structure 36 is located generally between high pressure turbine 54 and low pressure turbine 46. Mid-turbine frame 57 supports one or more bearing systems 38 in turbine section 28. Inner shaft 40 and outer shaft 50 are concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C is compressed by low pressure compressor section 44 then high pressure compressor 52, mixed and burned with fuel in combustor 56, then expanded over high pressure turbine 54 and low pressure turbine 46. Mid-turbine frame 57 includes airfoils 59 which are in the core airflow path. Turbines 46, 54 rotationally drive the respective low speed spool 30 and high speed spool 32 in response to the expansion.

Gas turbine engine 20 is a high-bypass geared aircraft engine. The bypass ratio of gas turbine engine 20 can be greater than about six (6). The bypass ratio of gas turbine engine 20 can also be greater than ten (10). Geared architecture 48 can be an epicyclic gear train, such as a star gear system (sun gear in meshing engagement with a plurality of star gears supported by a carrier and in meshing engagement with a ring gear) or other gear system. Geared architecture 48 can have a gear reduction ratio of greater than about 2.3 and low pressure turbine 46 can have a pressure ratio that is greater than about five (5). The bypass ratio of gas turbine engine 20 can be greater than about ten (10:1). The diameter of fan 42 can be significantly larger than that of the low pressure compressor section 44, and the low pressure turbine 46 can have a pressure ratio that is greater than about five (5:1). Low pressure turbine 46 pressure ratio is measured prior to inlet of low pressure turbine 46 as related to the pressure at the outlet of low pressure turbine 46 prior to an exhaust nozzle. It should be understood, however, that the above parameters are exemplary of particular embodiments of a suitable geared architecture engine and that the present disclosure contemplates other turbine engines including direct drive turbofans.

The next generation of turbofan engines are designed for higher efficiency and use higher pressure ratios and higher temperatures in high pressure compressor 52 than are conventionally experienced. These higher operating temperatures and pressure ratios create operating environments that cause thermal loads that are higher than the thermal loads conventionally experienced, which may shorten the operational life of current components.

Figure 2:
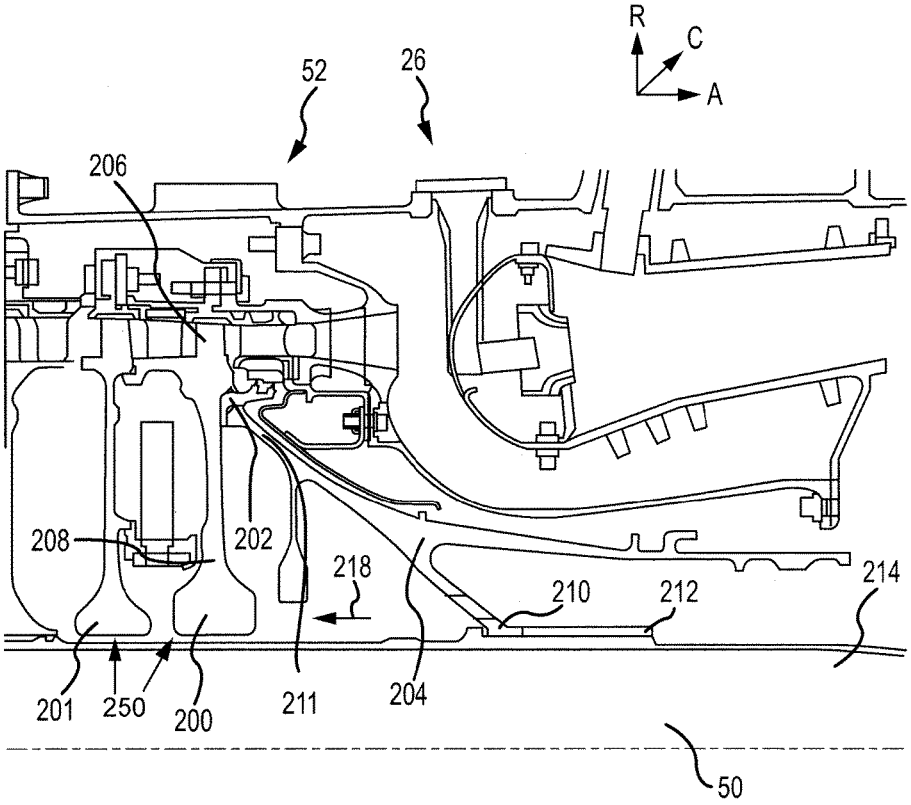
FIG. 2 illustrates a cross-sectional view of a portion of the gas turbine engine of FIG. 1 including a high pressure compressor and a combustor, in accordance with various embodiments.

With reference now to FIG. 2, high pressure compressor 52 includes a plurality of integrally bladed rotors (IBR) including IBR 200 and IBR 201. IBR 200 includes a rotor disk portion 208 and a blade portion 206. Rotor disk portion 208 and blade portion 206 are portions of a single component.

High pressure compressor 52 includes a hub rotor 204 having a radially inner arm 210 coupled to outer shaft 50 via an engine nut 212. A seal ring 202 is positioned between an outer arm 211 of hub rotor 204 and a portion of rotor disk portion 208 of IBR 200. With brief reference to FIGS. 1 and 2, seal ring 202 circumferentially surrounds axis A-A'. Returning reference to FIG. 2, a rotor stack 250 (including IBR 200, IBR 201 and other rotors and IBR's of high pressure compressor 52) of high pressure compressor 52 is coupled to outer shaft 50 at a location forward of IBR 201. In that regard, rotor stack 250 and seal ring 202 are held in place via compressive force applied via the coupling of rotor stack 250 to outer shaft 50 at the forward location and via the coupling of hub rotor 204 to outer shaft 50. Compressive force is defined as a force applied to an object from two sides that does not necessarily cause the object to reduce in size, quantity or volume. Stated differently, seal ring 202 is held in place by compressive force applied to seal ring 202 as a result of a forward force applied by hub rotor 204 and an aftward force applied by IBR 200. In that regard, seal ring 202 can be press fit into place between outer arm 211 of hub rotor 204 and rotor disk portion 208 of IBR 200.

Figure 3:
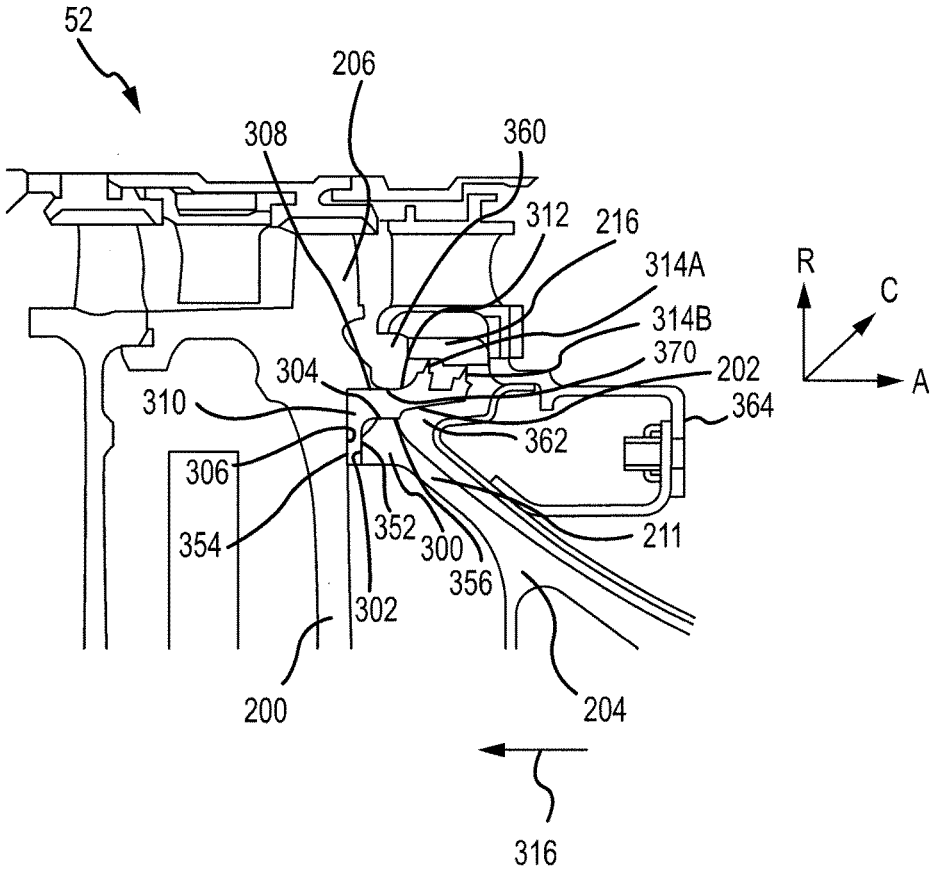
FIG. 3 illustrates a cross-sectional view of the high pressure compressor of FIG. 2, in accordance with various embodiments.

With reference now to FIG. 3, seal ring 202 includes a radial arm 310 and an axial arm 312. Radial arm 310 includes a aft axial face 302 and an forward axial face 306. In response to radial arm 310 being positioned between hub rotor 204 and IBR 200, aft axial face 302 of seal ring 202 aligns with and contacts a hub axial face 352 of outer arm 211 of hub rotor 204. In a similar manner, forward axial face 306 aligns with and contacts an IBR axial face 354 of IBR 200. Where used in this context, aligned with and contacts indicates that half or more of one of the two faces is in contact with the other face.

Seal ring 202 also includes an inward radial face 304 that aligns with and contacts a hub radial face 356 of outer arm 211 of hub rotor 204. Seal ring 202 also includes an outward radial face 370 that aligns with and contacts an IBR radial face 308 of IBR 200. Stated differently, radial arm 310 is positioned axially between IBR 200 and hub rotor 204. Axial arm 312 is positioned radially between IBR 200 and hub rotor 204. Seal ring 202 is removably coupled to IBR 200 and hub rotor 204 via a compressive force applied to seal ring 202 by IBR 200 and hub rotor 204 in the axial and radial directions.

With reference now to FIGS. 2 and 3, in response to hub rotor 204 being coupled to outer shaft 50 via engine nut 212, an axially forward force is applied to radial arm 310 by outer arm 211 of hub rotor 204 and by IBR 200. Similarly, a radially outward force is applied to axial au a 312 of seal ring 202 by outer arm 211 of hub rotor 204. The radially outward force applied to axial arm 312 is also applied to IBR 200 by axial min 312. In that regard, seal ring 202 is coupled in place in response to rotor stack 250 being coupled to outer shaft 50 in the forward location and hub rotor 204 being coupled to outer shaft 50 via engine nut. Seal ring 202 can be removed from its position between IBR 200 and hub rotor 204 by decoupling hub rotor 204 from outer shaft 50 and can be coupled to IBR 200 and hub rotor 204 by positioning seal ring 202 in place and coupling hub rotor 204 to outer shaft 50.

Axial arm 312 of seal ring 202 defines a first blade 314A and a second blade 314B. An abradable material 216 is coupled to a frame 364 and positioned adjacent first blade 314A and second blade 314B. Stated differently, first blade 314A and second blade 314B are in contact with abradable material 216, within half of an inch (1.27 centimeters (cm)), or within 1 inch (2.54 cm), or within 2 inches (5.08 cm) of abradable material 216. Outer shaft 50 can rotate relative to frame 364. In response to rotation of outer shaft 50, hub rotor 204 and IBR 200 will rotate at the same angular velocity as outer shaft 50 as they are coupled to outer shaft 50. Because seal ring 202 is press fit between hub rotor 204 and IBR 200, seal ring 202 will rotate with hub rotor 204 and IBR 200 at the same angular velocity.

After initial construction of high pressure compressor 52, first blade 314A and second blade 314B are in contact with abradable material 216. During an initial operation of compressor section 52, rotation of seal ring 202 relative to abradable material 216 causes first blade 314A and second blade 314B to remove portions of abradable material 216. As a result, first blade 314A and second blade 314B are positioned a relatively small distance from abradable material 216.

A first volume 360 can include fluid having a higher temperature than fluid within a second volume 362 as first volume 360 is within a gas path of high pressure compressor 52. With brief reference to FIGS. 2 and 3, the fluid within first volume 360 is received by combustor section 26 where it is combined with fuel and ignited. Returning reference to FIG. 3, fluid within second volume 362 is used to cool components of high pressure compressor 52 and other portions of the gas turbine engine. Accordingly, it is desirable to seal first volume 360 from second volume 362. The close proximity of first blade 314A and second blade 314B to abradable material 216 forms a rotating seal between first volume 360 and second volume 362.

Seal ring 202 can include the same material as IBR 200 and/or hub rotor 204, such as a nickel cobalt alloy. Seal ring 202 can be formed using machining, additive manufacturing, forging or the like. After manufacture, a protective coating can be coupled to the tips of first blade 314A and second blade 314B to increase resistance to friction and heat.

Use of a seal ring removably coupled to an IBR and hub rotor provides advantages. For example, seal ring 202 is subjected to less low cycle fatigue and is subject to less creep because it is removably coupled to IBR 200 and hub rotor 204. As an additional benefit, seal ring 202 can be easily replaced and/or repaired during servicing events. If a seal ring were coupled to an IBR or a hub rotor, repair of the seal ring would typically include removal the IBR and/or the hub rotor from the gas turbine engine. However, because seal ring 202 is a separate structure, seal ring 202 alone can be removed and repaired and/or replaced, resulting in an easier repair/replacement of seal ring 202.

Benefits, other advantages, and solutions to problems have been described herein with regard to specific embodiments. The scope of the disclosure, however, is provided in the appended claims.

The invention claimed is:

1. A seal ring for use between an integrally bladed rotor and a hub rotor of a compressor section of a gas turbine engine, the seal ring comprising:

a radial arm configured to be positioned axially between the integrally bladed rotor and the hub rotor;

an axial arm configured to be positioned radially between the integrally bladed rotor and the hub rotor, wherein the seal ring is removably coupled to the integrally bladed rotor and the hub rotor in response to a compressive force applied to the radial arm and the axial arm by the integrally bladed rotor and the hub rotor; and a first blade coupled to the axial arm and configured to form a seal between a first volume and a second volume;

wherein the seal ring is configured to rotate at a same angular velocity with both the integrally bladed rotor and the hub rotor.

2. The seal ring of claim 1, wherein the seal ring is positioned about an axis and configured to rotate about the axis in response to the integrally bladed rotor and the hub rotor rotating about the axis.

3. The seal ring of claim 1, wherein the compressor section is a high pressure compressor section.

4. The seal ring of claim 1, wherein the hub rotor is configured to be coupled to an outer shaft and the seal ring is configured to be decoupled from the integrally bladed rotor and the hub rotor by decoupling the hub rotor from the outer shaft.

5. A system comprising:

an integrally bladed rotor of a compressor section of a gas turbine engine, the integrally bladed rotor configured to rotate about an axis;

a hub rotor positioned aft of the integrally bladed rotor and configured to rotate about the axis; and a seal ring configured to be positioned between the integrally bladed rotor and the hub rotor and removably coupled to the integrally bladed rotor and the hub rotor via a compressive force and configured to rotate about the axis at a same angular velocity as both the integrally bladed rotor and the hub rotor, wherein the seal ring comprises a radial arm positioned axially between the integrally bladed rotor and the hub rotor and an axial arm positioned radially between the integrally bladed rotor and the hub rotor.

6. The system of claim 5, wherein the seal ring defines a first blade.

7. The system of claim 5, wherein the integrally bladed rotor includes a rotor disk portion and a blade portion.

8. The system of claim 5, wherein the compressor section is a high pressure compressor section.

9. The system of claim 5, further comprising an outer shaft and wherein the hub rotor is configured to be coupled to the outer shaft and the seal ring is configured to be decoupled from the integrally bladed rotor and the hub rotor by decoupling the hub rotor from the outer shaft.

10. A seal ring for use between an integrally bladed rotor and a hub rotor of a compressor section of a gas turbine engine, the seal ring comprising:

a radial arm configured to be axially positioned between the integrally bladed rotor and the hub rotor; and an axial arm configured to be radially positioned between the integrally bladed rotor and the hub rotor, such that the seal ring is removably coupled to the integrally bladed rotor and the hub rotor in response to a compressive force applied to the seal ring by the integrally bladed rotor and the hub rotor;

wherein the seal ring comprises at least one of:

the radial arm having a forward axial face configured to align with and contact a rotor axial face of the integrally bladed rotor and an aft axial face configured to align with and contact a hub axial face of the hub rotor; and the axial arm having an outer radial face configured to align with and contact a rotor radial face of the integrally bladed rotor and an inner radial face configured to align with and contact a hub radial face of the hub rotor.

11. The seal ring of claim 10, wherein the axial arm defines a first blade and a second blade.

12. The seal ring of claim 10, wherein the seal ring is positioned about an axis and configured to rotate about the axis in response to the integrally bladed rotor and the hub rotor rotating about the axis.

13. The seal ring of claim 10, wherein the compressor section is a high pressure compressor section.

* * * * *